United States Patent [19]

Flick

[11] 3,988,978

[45] Nov. 2, 1976

[54] BEVERAGE CAN FOLDER

[75] Inventor: Joseph J. Flick, Amarillo, Tex.

[73] Assignee: Oliver W. Bivins, Amarillo, Tex. ; a part interest

[22] Filed: May 30, 1975

[21] Appl. No.: 582,235

[52] U.S. Cl. ..... 100/35; 100/DIG. 2; 100/266; 100/295

[51] Int. Cl.[2] ..... B30B 13/00; B30B 1/04; B30B 9/32

[58] Field of Search ..... 100/DIG. 2, 35, 266, 100/295; 241/99; 294/103

[56] References Cited

UNITED STATES PATENTS

| | | | |
|---|---|---|---|
| 1,591,354 | 7/1926 | Baillie | 294/103 |
| 2,603,270 | 7/1952 | Voigt | 100/DIG. 2 |
| 2,614,604 | 10/1952 | Coffey | 100/DIG. 2 |
| 2,678,000 | 5/1954 | Scheidt | 100/266 |
| 2,958,273 | 11/1960 | Morrow | 100/DIG. 2 |
| 3,009,414 | 11/1961 | Griemert | 100/DIG. 2 |
| 3,667,386 | 6/1972 | Workman | 100/DIG. 2 |
| 3,732,804 | 5/1973 | Moller | 100/295 X |
| 3,766,849 | 10/1973 | Maron | 100/DIG. 2 |
| 3,776,129 | 12/1973 | Carlson | 100/266 X |
| 3,777,659 | 12/1973 | McCarten | 100/295 X |
| 3,853,054 | 12/1974 | Jacobsen | 100/DIG. 2 |

*Primary Examiner*—Billy J. Wilhite
*Attorney, Agent, or Firm*—Wendell Coffee

[57] ABSTRACT

A bending foot is placed in the middle of an aluminum beer can laying on the roadside and the foot is pushed down by a stalk extending upward from the foot. This causes the ends of the can to angle inward as the center of the can is flattened out; then, the ends of the can are folded over the foot by stepping on a platen which is telescoped to the stalk. With the can folded around the foot, the tool with the can is lifted and the can slipped off.

7 Claims, 5 Drawing Figures

BEVERAGE CAN FOLDER

CROSS-REFERENCE TO RELATED APPLICATIONS

None.

BACKGROUND OF THE INVENTION

1. Field of the Invention

This invention relates to presses and more particularly to can crushers or folders. (100/Dig. 2)

2. Description of the Prior Art

Great efforts are being made to prevent the wastes of society from becoming obnoxious. In today's affluent society, one of the principal concerns is beverage cans which are often strewn around public places. At present time, these cans are normally gathered by young persons who often crush them with their feet.

Certain devices have been made to crush the cans. More generally, these have been applicable for use in bars and places where the contents of the beverage can is dispensed. Some of these crushers are characterized by first bending the middle of the can inward so the ends may be more easily flattened. However, it appears that all of them are quite heavy, bulky, and somewhat complex, often with a plurality of moving parts.

The following is a list of patents of which the applicant was aware of at the time of preparation of this application:

| | |
|---|---|
| 2,603,270 | Voight |
| 2,614,604 | Coffey |
| 2,958,273 | Morrow |
| 3,667,386 | Workman |
| 3,732,804 | Moller |
| 3,766,849 | Maron |
| 3,776,129 | Carlson |
| 3,777,659 | McCarten |
| 3,853,054 | Jacobsen |

SUMMARY OF THE INVENTION

1. New and Different Function

I have invented a beer can folder which is particularly adapted to harvesting or flattening and picking up aluminum beer cans from the roadside. In no way do I mean to indicate that the structure found is not applicable also to a permanent installation in a bar or other place, or, also, that the device could not be used for folding steel cans as well as aluminum cans. However, a simple device is provided which has a foot on the end of an elongated handle or stalk and the sole of the foot is placed in the middle of the can and pushed down. This flattens the center of the can against a supporting surface, normally the ground. When the center of the can is flattened, the ends turn toward the center and are folded down over the foot by the operator stepping on top of the platen, temporarily attaching the can to the foot of the tool. Then, the can may be readily picked up, without the operator ever stooping or bending over, and easily removed from the foot and placed in a sack or some suitable container.

The platen is held in a raised position above the foot of the device by a spring extending from a sleeve on the platen to the stalk. If the spring is reasonably stout, the first bending in the middle of the can by the sole of the foot may be accomplished by stepping on the platen and the strength of the spring is sufficient to cause the center of the can to flatten.

2. Objects of this Invention

An object of this invention is to flatten beverage cans.

Another object is to provide a tool so a person may flatten and pick up cans without having to stoop or bend.

Other objects are to achieve the above with a device that is sturdy, compact, durable, lightweight, simple, safe, efficient, versatile, and reliable, yet inexpensive and easy to manufacture, operate and maintain.

Further objects are to achieve the above with a method that is versatile, rapid, efficient, and inexpensive, and does not require skilled people to operate and maintain.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Figure 3:
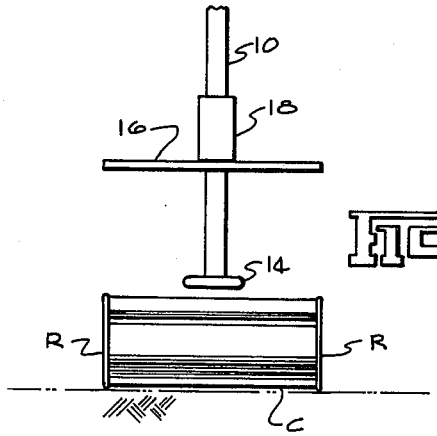
FIG. 3 is a front elevational view of the lower portion of the tool shown in position above a can resting upon the supporting surface of the ground.
Figure 4:
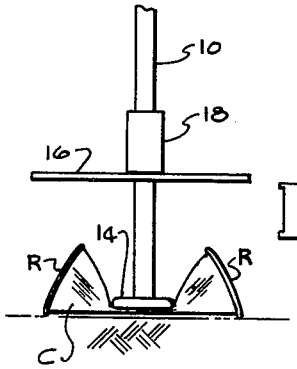
FIG. 4 is a front elevational view similar to FIG. 3 showing the position of the tool with regard to the can after the middle of the can is bent flat against the supporting surface.
Figure 5:
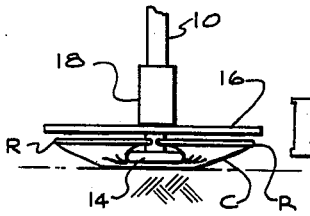
FIG. 5 shows the next step with the platen having been pushed down and the ends of the can folded over the foot.

Referring more particularly to the drawing, there may be seen a tool having a general upright leg or stalk 10. This stalk has handle 12 at the top and horizontal bending foot 14 is on the bottom. The bending foot 14 is at right angles to the stalk 10 and has a planar sole on its bottom surface, i.e., opposite the stalk 10. The distance from the bending foot 14 to the handle 12 is a convenient distance for a person to use the tool without stooping or bending. The bending foot 14 has a width, as shown in FIGS. 3, 4, and 5, which is equal to less than one-third the length of a typical beverage can *c.* E.g., a typical beverage can is about 13 cm in length and the foot, therefore, would be about 4 cm in width. The length of the foot along the ground would be slightly more than the diameter of the can. I.e., referring to FIG. 1, the length of the foot as seen there would be about 7 cm with a typical can being about 6 cm in diameter. I.e., the width is about 0.6 times the length.

Platen 16 is horizontal and, therefore, is parallel to the bending foot 14. The platen 16 is mounted for vertical reciprocation on the tool on the opposite side of the foot 14 from the sole. This is achieved by placing tubular sleeve 18 attached to the platen around the stalk 10. The sleeve 18 attached to the platen around the stalk 10. The sleeve, and thus the platen 16, is held in the raised position by spring 20 which connects between a suitable connection, such as a screw, on the sleeve 18 and a screw on the stalk 10 thereabove.

Figure 1:
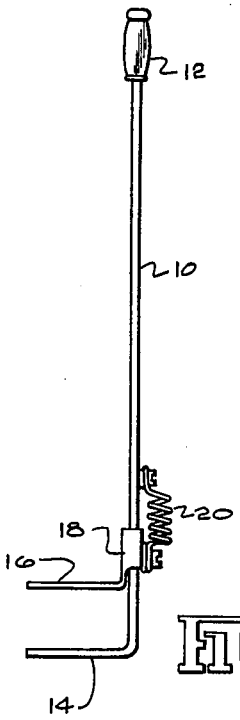
FIG. 1 is a side elevational view of an embodiment of this invention.
Figure 2:
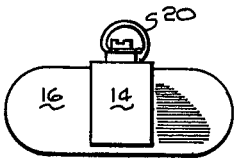
FIG. 2 is a bottom plan view of the embodiment shown in FIG. 1.

The platen has a width as seen in FIGS. 3, 4, and 5, about equal a typical beverage can. As stated before, the typical beverage can has a height of about 13 cm and, therefore, the platen 16 has a width of about 12.5 cm. It also has a length a little greater than the diameter of a beverage can and, also, greater than the foot 14 as seen in FIG. 1. I have had good success using a length of about 7.5 cm. As seen in FIG. 2, the platen 16 overlays the foot 14 and the platen 16 extends to either side of the foot 14 a distance equal to the width of the foot.

In operation the can lies on its side on a supporting surface, which, as illustrated, is the ground in the park or roadside. The bending foot is placed about the middle of the can with the planar sole against the middle of the can. Then, the bending foot is moved downward, flattening the middle of the can against the supporting surface as seen in FIG. 4. It will be understood that the stalk forms a means connected to the foot for moving the foot toward the surface. Further, if the spring 20 is rather a stout spring, the flattening of the can may be assisted by stepping on the top of the platen so the can bends and flattens rather than the spring extending.

After the can has been flattened in the middle as seen in FIG. 4, then with the operator's foot on top of the platen, the platen is moved down, i.e., it is moved toward the bending foot and the supporting surface, this causes the ends or rims of the cans to be folded over the bending foot, particularly as seen in FIG. 5. When the weight of the operator's foot is removed from the top of the platen, the spring 20 will raise the platen or move the platen away from the bending foot 14. Then, the entire tool is lifted with the can thereon, the can slid from the bending foot and placed in a sack.

As stated before, the description of this tool is made particularly for a portable unit to be used in flattening and picking up cans outdoors. However, it will be understood by those skilled in the art that the structure as described could be used in a unit mounted at a point of dispensing, in which case, the surface against which the foot 14 moved would be a surface other than the ground.

The embodiment shown and described above is only exemplary. I do not claim to have invented all the parts, elements or steps described. Various modifications can be made in the construction, material, arrangement, and operation, and still be within the scope of my invention. The limits of the inventions and the bounds of the patent protection are measured by and defined in the following claims. The restrictive description and drawing of the specific example above do not point out what an infringement of this patent would be, but are to enable the reader to make and use the invention.

I claim as my invention:

1. The method of flattening and picking up empty beverage cans on a surface with a tool having a. an upright stalk with i. a handle on one end and ii. a horizontal bending foot on the other, and b. a horizontal moveable platen on the stalk above the foot, c. COMPRISING THE STEPS OF:

d. placing the bending foot on and across the can at about the middle, e. bending the can down at the middle with the bending foot and f. folding the ends of the can down over the bending foot by downward movement of the platen, and, then, g. lifting the tool with the can thereon, and h. sliding the can from the bending foot.

2. A tool for flattening empty beverage cans against a surface comprising:

a. a bending foot having a planar sole adapted to bend the middle of a can flat against the surface, b. the foot having a length and a width, the width being about six-tenths times the length and the length being at least as long as the diameter of the beverage can to be flattened, c. means connected to the foot for moving the foot toward the surface, d. a platen connected to the bending foot and located on the opposite side of the foot from the sole, e. said platen overlaying the foot with the foot centered beneath the platen, f. the platen having a length at least as long as the diameter of the beverage can to be flattened, g. the platen having a width at least three times the width of the foot, which is to say the platen extends to each side of the foot a distance equal to the width of the foot, h. said platen parallel to the planar sole, j. said platen mounted for movement toward and away from said foot, and k. means interconnecting the foot and platen for moving the platen away from the surface and foot.

3. The invention as defined in claim 2 with additional limitations of m. the foot being 7 cm long and 4 cm wide and n. the platen being 7.5 cm long and 12.5 cm wide.

4. The invention as defined in claim 2 wherein said means for moving the foot includes h. a stalk attached to the foot at right angles thereto, extending opposite said sole.

5. The invention as defined in claim 4 wherein said platen is mounted for movement by j. a sleeve on the platen telescoped around said stalk.

6. The invention as defined in claim 5 wherein said means for moving the platen away from said foot includes k. a spring extending from said sleeve to said stalk attached to said foot.

7. The invention as defined in claim 6 with additional limitations of p. the foot being 7 cm long and 4 cm wide and q. the platen being 7.5 cm long and 12.5 cm wide.

* * * * *